US008358785B2

(12) United States Patent
Nikles et al.

(10) Patent No.: US 8,358,785 B2
(45) Date of Patent: Jan. 22, 2013

(54) HEARING SYSTEM WITH WIDEBAND PULSE TRANSMITTER

(75) Inventors: Peter Nikles, Erlangen (DE); Ulrich Schätzle, Forchheim (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1261 days.

(21) Appl. No.: 11/807,386

(22) Filed: May 29, 2007

(65) Prior Publication Data

US 2007/0291970 A1 Dec. 20, 2007

Related U.S. Application Data

(60) Provisional application No. 60/809,263, filed on May 30, 2006.

(51) Int. Cl.
*H04R 25/00* (2006.01)

(52) U.S. Cl. ..... 381/23.1; 381/312; 381/315; 381/323; 455/41.1; 455/41.2; 455/522

(58) Field of Classification Search ..... 381/23.1, 381/60, 312, 72, 302, 303, 311, 315, 321, 381/323, 328, 331, 74, 77, 79, 97, 98, 367, 381/370, 376; 455/552, 556.1, 343.6, 569.1, 455/41.1, 41.2, 41.3, 573, 575.1, 575.2, 567, 455/3.05, 563, 570; 379/428.02
See application file for complete search history.

(56) References Cited

U.S. PATENT DOCUMENTS

| | | | | |
|---|---|---|---|---|
| 5,721,783 | A | 2/1998 | Anderson | |
| 5,751,820 | A | 5/1998 | Taenzer | |
| 6,046,244 | A | 4/2000 | Büyüktimkin et al. | |
| 6,765,883 | B1 | 7/2004 | van Heeswyk | |
| 6,816,600 | B1 | 11/2004 | Jakob et al. | |
| 6,853,835 | B2 | 2/2005 | Wynbeek | |
| 7,020,296 | B2 | 3/2006 | Niederdränk | |
| 2004/0013280 | A1 * | 1/2004 | Niederdrank | 381/315 |
| 2005/0100182 | A1 * | 5/2005 | Sykes et al. | 381/315 |
| 2005/0283207 | A1 * | 12/2005 | Hochmair et al. | 607/55 |
| 2006/0018496 | A1 | 1/2006 | Niederdrank et al. | |

FOREIGN PATENT DOCUMENTS

| | | | |
|---|---|---|---|
| CN | 1191060 | A | 8/1998 |
| CN | 2591913 | Y | 12/2003 |
| CN | 2625967 | Y | 7/2004 |
| CN | 1725905 | A | 1/2006 |
| DE | 10228157 | B3 | 1/2004 |
| DE | 602 02 618 | T2 | 12/2005 |

(Continued)

OTHER PUBLICATIONS

Jan D. O'Donnell and Robert W. Brodersen, "An Ultra-Wideband Transceiver Architecture for Low Power, Low Rate, Wireless Systems", IEEE Transactions on Vehicular Technology, vol. 54, No. 5, Sep. 2005, pp. 1623-1631.

*Primary Examiner* — Vivian Chin
*Assistant Examiner* — Leshui Zhang

(57) ABSTRACT

Wireless communication is to be enabled between hearing units of small construction, especially between hearing aids with an increased data rate. To this end it is provided in accordance with the invention that the hearing unit is fitted with a transceiver which has an inductive receiving device and a digital wideband pulse transmitter. Two such hearing units can then communicate wirelessly with one another with the help of a communication station which is structurally separate from the hearing units and with which a message can be transmitted from the one to the other of the hearing units. The digital wideband pulse transmitter can be implemented in a structurally small manner in the hearing unit and with low power consumption.

12 Claims, 1 Drawing Sheet

FOREIGN PATENT DOCUMENTS

| | | | | |
|---|---|---|---|---|
| JP | 11511301 | | | 9/1999 |
| JP | 2003511876 | | | 3/2003 |
| JP | 2004504786 | A | | 2/2004 |
| JP | 2004504789 | | | 2/2004 |
| JP | 2004535082 | | | 11/2004 |
| JP | 2005269053 | A | | 9/2005 |
| WO | WO 2004110099 | A2 | * | 12/2004 |
| WO | WO 2004114722 | A1 | * | 12/2004 |

* cited by examiner

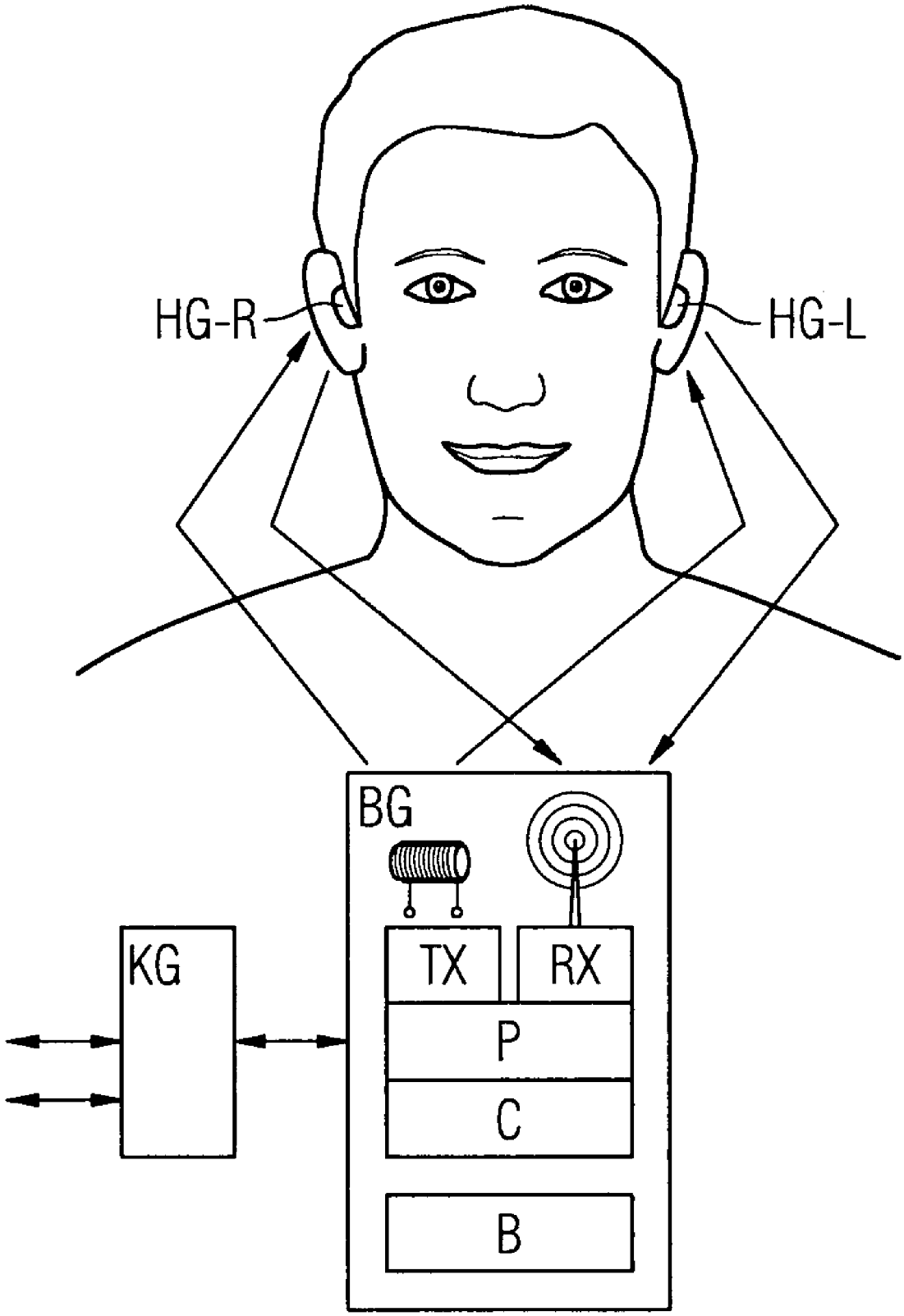
HG-R
HG-L
BG
TX
RX
P
C
B
KG

HEARING SYSTEM WITH WIDEBAND PULSE TRANSMITTER

CROSS REFERENCE TO RELATED APPLICATIONS

The present application claims the benefit of the provisional patent application filed on May 30, 2006, and assigned application No. 60/809,263, which is incorporated herein by reference in its entirety.

FIELD OF THE INVENTION

The present invention relates to a hearing system with a transceiver. In addition the present invention relates to a hearing system with at least two hearing units designed for wireless communication with one another, and a communication station, by means of which messages can be transmitted between the hearing units. Hearing units here refers not only to hearing aids, but also to headsets, headphones, etc.

BACKGROUND OF THE INVENTION

It is known for audio signals for hearing aids to be transmitted in analog fashion in the baseband via inductively coupled coils. For example, so-called telephone coils are used to transmit voice signals when telephoning. In addition, induction loops are used in museums, churches, etc. to send signals to hearing aids. As well as this, coils are also used to transmit signals from one hearing aid to another in the case of a cross system (where the hearing aid wearer is wearing two hearing aids).

The analog transmission of audio signals typically takes place using a modulated carrier. To this end, the hearing aids have corresponding AM/FM receivers. In the cross system the behind-the-ear hearing aids also have AM/FM transmitters.

Besides the wireless transmission of signals, wired transmission between the hearing aids is also possible. In addition, wired transmission is possible from an external audio device to a hearing aid via an audio shoe plug.

The article "An Ultra-Wideband Transceiver Architecture for Low Power, Low Rate, Wireless Systems", IEEE TRANSACTIONS ON VEHICULAR TECHNOLOGY, VOL. 54, NO. 5, SEPTEMBER 2005, pages 1623 to 1631 describes a wideband pulse transmission technique for wireless systems. The transmission technique is characterized by low power consumption. The data transmission rate is comparatively high in hearing aid terms.

SUMMARY OF THE INVENTION

The object of the present invention is to propose a hearing unit enabling wireless communication at low power consumption and increased data transmission rate. In addition, a corresponding hearing system is to be specified, in which a plurality of hearing units communicate in the aforementioned way.

According to the invention, this object is achieved by a hearing system having a transceiver which has an inductive receive device and a digital wideband pulse transmitter.

Also provided in accordance with the invention is a hearing system having at least two spatially separated hearing units of the type referred to, which are designed for wireless communication with one another, and a communication station which is structurally separate from the hearing units, and with which a message can be transmitted from one of the hearing units to another of the hearing units.

Digitally modulated magnetic field signals can preferably be transmitted between the hearing units, thereby enabling secure transmission with little hardware requirement.

The bandwidth of each of the wideband pulse transmitters is at least 100 MHz. This means a comparatively high data rate can be achieved.

Each of the wideband pulse transmitters is connected to a miniaturized electrical antenna, the maximum dimension of which is preferably between 8 and 20 mm, enabling the size of the hearing units and especially of the hearing aids to be reduced.

According to a preferred embodiment bidirectional, quasi-simultaneous communication can be conducted between the hearing units via the communication station. To this end, it can be advantageous if control information is also transmitted from the communication station during communication. This quasi-simultaneous, bidirectional communication is possible because communication takes place in one time window in one direction and in a subsequent time window in the other direction. As a result, the transceivers can be implemented with little effort.

In addition, the communication station can have a bidirectional interface to an external configuration device. It is especially favorable if configuration data can be transmitted from the configuration device to one of the hearing units via the communication station. The communication station thus acquires the dual function of transmitting signals between the hearing units as well as signals from a configuration device to a hearing unit.

BRIEF DESCRIPTION OF THE DRAWINGS

The present invention will now be explained in greater detail on the basis of the enclosed drawing, which shows a basic sketch of an inventive system having two hearing aids.

DETAILED DESCRIPTION OF THE INVENTION

The exemplary embodiments outlined in greater detail below represent preferred embodiments of the present invention.

The FIG shows a hearing aid wearer with a left hearing aid HG-L in his left ear and a right hearing aid HG-R in his right ear. Communication between both hearing aids is via a portable base device BG. The hearing aid wearer can for example wear the said base device BG in his breast pocket and it assumes the function of the communication station.

Digital receivers and transmitters for audio signals are installed separately in each of the hearing aids HG-R and HG-L. Both are adapted to the extreme demands on hearing aids as regards size and power required. If the called station in the communication is a portable base device BG with less critical demands, more complexity can be used for the transmitters and receivers incorporated therein, in order to offset the limitations in the hearing aids.

In a favorable embodiment, a miniaturized coil is used for the receiver in the hearing aids HG-R and HG-L. Its maximum dimension is preferably between 4 and 8 mm. Such coils are also used for example for remote operation of hearing aids.

The receiver coils of the hearing aids receive the digitally modulated magnetic field signal from a transmitter, which has a significantly larger and thus more effective transmission coil and which is incorporated into the base device BG. The signal path is symbolized in the FIG by arrows from the base device BG to the hearing aids HG-R and HG-L. The inductive transmitter is designated as TX in the FIG. It is controlled by a signal processing unit P having a memory and a communication interface C. The base device BG further has a battery B, as well as operating and display elements (not shown).

A likewise miniaturized electrical antenna is used for the transmitter in the hearing aids HG-R and HG-L, and emits wideband pulsed signals at low transmission field strength. The technique of emitting wideband pulsed signals is known from the article already mentioned in the introduction—"An Ultra-Wideband Transceiver Architecture for Low Power, Low Rate, Wireless Systems". This technology allows signals to be emitted by the transmitter using very little power. These signals are represented by arrows from the hearing aids HG-R and HG-L to the base device BG in the FIG.

So that the weak, wideband pulsed signals can be received in the base device BG with sufficient quality, a significantly larger and thus more effective electrical receive antenna is incorporated therein. Implementation of the receive circuit and the receiver RX likewise requires a great deal of effort in order to detect the weak signals reliably.

If a so-called cross system is necessary for the patient, the digital audio signal can be passed via the base device BG from one hearing aid HG-R to the opposite hearing aid HG-L or vice versa. In the base of a bi-cross system for the patient the digital audio signals can be passed via the base device BG from right to left and quasi-simultaneously from left to right. For this purpose, control signals are also transmitted from the base device BG to effect an alternating transmission of the wideband pulsed signals of the relevant hearing aids HG-R and HG-L.

To configure the base device BG, a bidirectional interface to a configuration device KG is optionally provided. The interface can either be a simple serial wired interface (e.g. Universal Serial Bus) or a wireless interface (e.g. Bluetooth, Zigbee, WLAN). In a further step, the bidirectional interface can also be used to reconfigure programmable hearing aids. In this case, program data is transmitted instead of the digitized audio data, and the base device works as a communication station from and to the configuration device. The configuration device can be a PC or a notebook on which the fitting software for the hearing aid acoustician is installed.

Thanks to the combination of the digital audio receiver method (inductive coupling), which is favorable for hearing aids, with the digital audio transmitter method (electrical wideband pulses), which is favorable for hearing aids, it becomes possible to make available a wireless transmitter-receiver (transceiver) strategy which saves considerable power and space. The expensive functions are implemented in a base device separate from the hearing units and the hearing aids, since it acts as a communication station and makes few demands on power consumption and space requirement.

When reconfiguring programmable hearing aids, the fast data rate of the hearing aids is of great benefit, since it enables all the data stored in the hearing aid to be read out very fast.

The high data rate for communication with a hearing aid further opens up the possibility of implementing new hearing aid strategies. Thus the publication DE 10228157 describes hearing aids with signal processing relocated to an external unit. Until now this has failed in practice as regards implementation of a fast data channel from the hearing aids to the external unit, but it is now possible with the inventive hearing units.

The invention claimed is:

1. A hearing aid system, comprising:

at least two spatially separated hearing aid units wore on left ear and right ear of a user, respectively, and the each hearing aid unit having a transceiver for enabling wireless communication, wherein each transceiver includes an inductive receiving device and a digital wideband pulse transmitter;

a portable communication station structurally separated from the at least two hearing aid units and wherein a signal including a data signal and a control signal is transmitted from the digital wideband pulse transmitter of the transceiver of the one hearing aid unit to the portable communication station and then transmitted from the portable communication station to the inductive receiving device of the transceiver of the other one hearing aid unit so that a power consumption and an overall size of each hearing aid unit are reduced; and a configuration device that can be coupled to the portable communication station for configuration purpose and communicated with the portable communication station by using a bidirectional communication and wherein the portable communication station is configured by the configuration device to provide quasi-simultaneous communication of the signal between the at least two hearing aid units through the portable communication station.

2. The hearing aid system as claimed in claim 1, wherein the signal is a digitally modulated magnetic field signal.

3. The hearing aid system as claimed in claim 2, wherein a bandwidth of the digital wideband pulse transmitter is at least 100 MHz.

4. The hearing aid system as claimed in claim 2, wherein an electrical antenna of the digital wideband pulse transmitter is smaller than 20 mm.

5. The hearing aid system as claimed in claim 1, wherein the portable communication station comprises a bidirectional interface to the configuration device.

6. The hearing aid system as claimed in claim 5, wherein a configuration data is transmitted by the portable communication station from the configuration device to one of the at least two hearing aid units.

7. A method for wirelessly communicating between at least two spatially separated hearing aid units wore on left ear and right ear of a user, respectively, comprising:

arranging a digital wideband pulse transmitter in a transceiver of each of the at least two hearing aid units;

arranging an inductive receiving device in the transceiver of each of the at least two hearing aid units;

providing a portable communication station structurally separated from the at least two hearing aid units;

transmitting a signal including a data signal and a control signal from the digital wideband pulse transmitter of the transceiver of the one hearing aid unit to the portable communication station and then transmitted from the portable communication station to the inductive receiving device of the transceiver of the other one hearing aid unit so that a power consumption and an overall size of each hearing aid unit are reduce; and configuring the portable communication station by a configuration device that can be coupled to the portable communication station for configuration purpose and communicated with the portable communication station by using a bidirectional communication for providing quasi-simultaneous communication of the signal between the at least two hearing aid units through the portable communication station.

8. The method as claimed in claim 7, wherein the signal is a digitally modulated magnetic field signal.

9. The method as claimed in claim 7, wherein a bandwidth of the digital wideband pulse transmitter is at least 100 MHz.

10. The method as claimed in claim 7, wherein an electrical antenna of the digital wideband pulse transmitter is smaller than 20 mm.

11. The method as claimed in claim 7, wherein the portable communication station comprises a bidirectional interface to the configuration device.

12. The method as claimed in claim 11, wherein a configuration data is transmitted by the portable communication station from the configuration device to one of the at least two hearing aid units.

* * * * *